US008251481B2

(12) United States Patent
Ihara

(10) Patent No.: US 8,251,481 B2
(45) Date of Patent: Aug. 28, 2012

(54) LIQUID EJECTING APPARATUS

(75) Inventor: Seiji Ihara, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 163 days.

(21) Appl. No.: 12/730,942

(22) Filed: Mar. 24, 2010

(65) Prior Publication Data

US 2010/0245451 A1 Sep. 30, 2010

(30) Foreign Application Priority Data

Mar. 26, 2009 (JP) ..... 2009-075927

(51) Int. Cl.
*B41J 29/38* (2006.01)
*B41J 2/01* (2006.01)

(52) U.S. Cl. ..... 347/16; 347/104

(58) Field of Classification Search ..... 347/16, 347/104
See application file for complete search history.

(56) References Cited

U.S. PATENT DOCUMENTS 6,543,948 B2 * 4/2003 Beehler et al. ..... 400/635
2006/0279752 A1 * 12/2006 Hatasa et al. ..... 358/1.8

FOREIGN PATENT DOCUMENTS

JP 61-280965 * 12/1986 ..... 347/104
JP 05-031893 2/1993
JP 2004-223962 8/2004
JP 2007223139 * 9/2007 ..... 347/104

* cited by examiner

*Primary Examiner* — Julian Huffman
(74) *Attorney, Agent, or Firm* — Workman Nydegger

(57) ABSTRACT

A liquid ejecting apparatus includes: a liquid ejecting head provided with nozzle orifices which eject liquid; a heater provided facing a liquid ejecting face of the liquid ejecting head; a transport section which transports an ejection-receiving medium between the liquid ejecting head and the heater; and a suction section which sucks the ejection-receiving medium toward the opposite side to the liquid ejecting head; wherein the suction section is provided so as to be able to change suction power in a plurality of regions along one direction of the ejection-receiving medium, and the liquid ejecting apparatus further includes a suction controller which controls the suction power in a plurality of regions of the suction section along one direction on the basis of the width in one direction of the ejection-receiving medium.

5 Claims, 7 Drawing Sheets

LIQUID EJECTING APPARATUS

BACKGROUND

1. Technical Field

The present invention relates to a liquid ejecting apparatus having a liquid ejecting head which ejects liquid onto an ejection-receiving medium.

2. Related Art

An ink jet type recording apparatus such as an ink jet type printer or a plotter has an ink jet type recording head which can discharge ink stored in an ink storage section such as an ink cartridge or an ink tank, as ink droplets.

Here, the ink jet type recording head is provided with pressure generation chambers which are communicated with nozzle orifices, and pressure generators which make pressure changes occur in the pressure generation chambers, thereby discharging liquid droplets out of the nozzle orifices. Then, as the pressure generator which is mounted in the ink jet type recording head, a longitudinal vibration type piezoelectric element, a flexural vibration type piezoelectric element, a heater element, an element using electrostatic force, or the like can be given as an example.

Also, as the ink jet type recording apparatus, there is proposed a recording apparatus constituted so as to dry ink printed on a recording sheet by heating a platen with a heating section such as a heater (for example, refer to JP-A-2004-223962, JP-A-5-31893, and JP-A-2004-223962).

Here, if a heater is provided in order to dry ink, the ink jet type recording head is heated by the heat of the heater, so that a volatile component of the ink adjacent to the nozzle orifice evaporates, and therefore, viscosity of the ink adjacent to the nozzle orifice is increased, so that there is a fear that discharging instability will be caused by the thickened ink, and further, if drying proceeds, there is a fear that clogging of the nozzle orifice will occur.

Further, there is a problem in which, if an ink droplet, ink mist, or the like attached to the nozzle plate exists, the viscosity of the ink is increased by the drying by heat, and further, due to the attachment of dust to the ink, the ink is attached to the vicinity of the nozzle orifice as a foreign material, so that clogging of the nozzle orifice occurs or discharging defects occur in which ink droplets cannot be discharged in the desired direction at the time of the start of discharging.

Also, there is a problem that if the ink jet type recording head is heated, due to a difference in the coefficient of thermal expansion between the constituent members of the ink jet type recording head, an adhesive agent or the like, which bonds the members to each other is destroyed, or deterioration of the constituent members of the head or the adhesive agent due to a solvent contained in ink is facilitated by the heat, so that there is a fear that the durability of the ink jet type recording head is lowered.

In addition, such problems are not limited to the ink jet type recording apparatus, but similarly exist also in a liquid ejecting apparatus which ejects liquid other than ink.

SUMMARY

An advantage of some aspects of the invention is that it provides a liquid ejecting apparatus which is able to reduce discharging defects and improve durability of a head without reduction in print quality.

According to a first aspect of the invention, there is provided a liquid ejecting apparatus including: a liquid ejecting head provided with nozzle orifices which eject liquid; a heater provided facing a liquid ejecting face of the liquid ejecting head; a transport section which transports an ejection-receiving medium between the liquid ejecting head and the heater; and a suction section which sucks the ejection-receiving medium toward the opposite side to the liquid ejecting head; wherein the suction section is provided so as to be able to change suction power in a plurality of regions along one direction of the ejection-receiving medium, and the liquid ejecting apparatus further includes a suction controller which controls the suction power in a plurality of regions of the suction section along one direction on the basis of the width in one direction of the ejection-receiving medium.

In this aspect, a heated temperature of a desired liquid ejecting head is lowered by adjusting the suction power of the suction section in one direction of the ejection-receiving medium, so that discharging defects due to the heating of the liquid ejecting head, or reduction in the durability of the liquid ejecting head can be suppressed. Also, since the heated temperature of a desired liquid ejecting head can be lowered without the lowering of the temperature at which the ejection-receiving medium is heated by the heater, the drying of liquid can be facilitated by the heater, and also, since the suction and adhesion of the ejection-receiving medium is reliably performed by the suction section, the ejection-receiving medium can be reliably fixed, so that print quality is not lowered.

Here, it is preferable that the suction controller perform control so as to make the suction power of a region of the suction section, where the ejection-receiving medium does not exist, be larger compared to the suction power of a region of the suction section, which faces the ejection-receiving medium. According to this, it is possible to lower the heated temperature of the liquid ejecting head which is not used for the ejection of liquid and in which viscosity of liquid adjacent to the nozzle orifice is easily increased.

Further, it is preferable that a support section which supports the ejection-receiving medium be provided at a region which faces the liquid ejecting face of the liquid ejecting head, the heater be provided at the support section, and the suction section include a plurality of suction holes provided along one direction in a region of the support section, which faces the liquid ejecting face, so that the suction section sucks and sticks the ejection-receiving medium to the support section. According to this, it is possible to efficiently refrigerate the vicinity of the nozzle orifice of the liquid ejecting head, and also it is possible to efficiently lower the heated temperature of the liquid ejecting head by partly lowering a temperature of the support section.

Further, it is preferable that a plurality of nozzle orifices be provided along one direction of the ejection-receiving medium. According to this, it is possible to lower the heated temperature of the vicinity of the nozzle orifice which is not used for the ejection of liquid.

Further, it is preferable that the liquid ejecting head be provided in a plurality of numbers along one direction of the ejection-receiving medium. According to this, it is possible to perform printing in a short time over a wide range in one direction of the ejection-receiving medium without making the head itself in a larger size, and also it is possible to lower the heated temperature of the liquid ejecting head which is not used for the ejection of liquid.

Further, it is preferable that one direction of the ejection-receiving medium be a direction crossing the relative movement direction of the liquid ejecting head and the ejection-receiving medium. According to this, it is possible to lower the heated temperature of the vicinity of the nozzle orifice which is not used for the ejection of liquid, in the direction crossing the relative movement direction of the liquid ejecting head and the ejection-receiving medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be explained in detail on the basis of embodiments.

Embodiment 1

Figure 1:
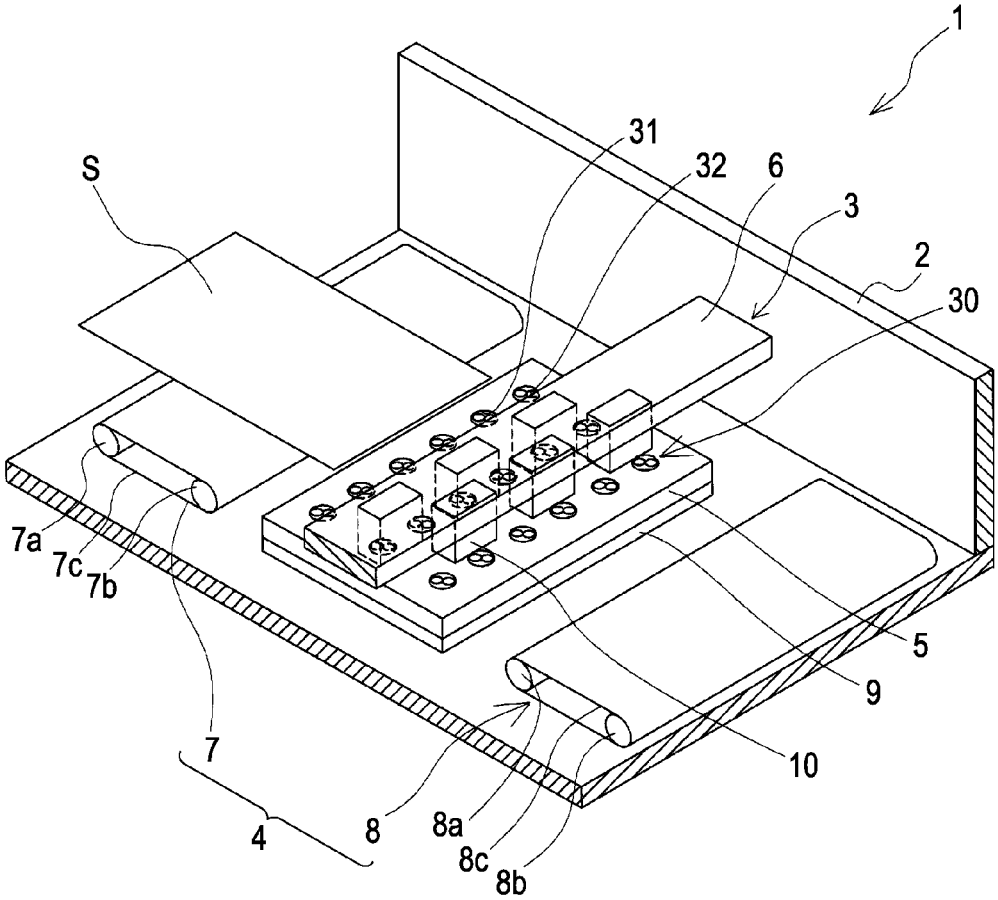
FIG. 1 is a schematic perspective view of a recording apparatus related to Embodiment 1 of the invention.
Figure 2:
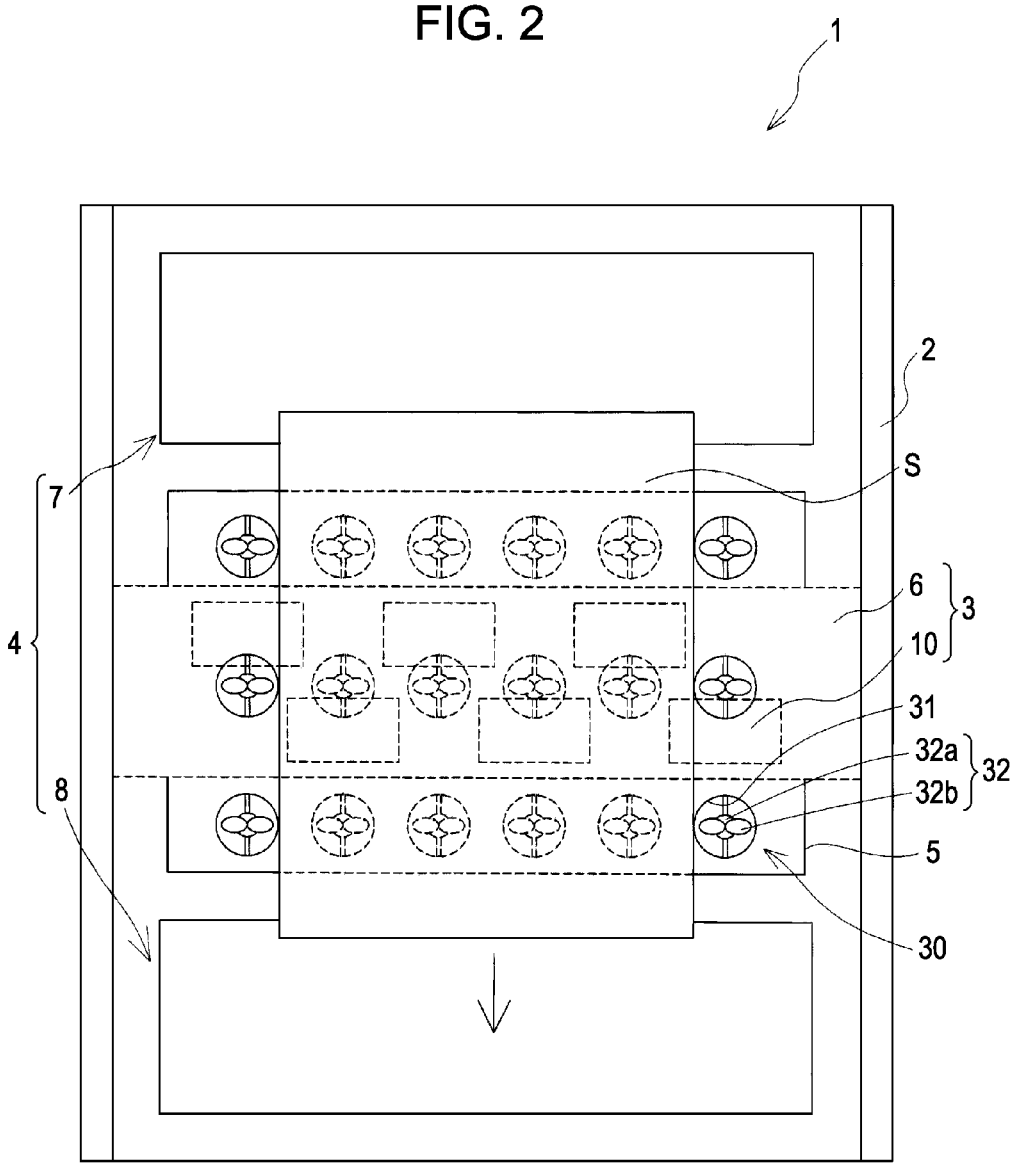
FIG. 2 is a top view of the recording apparatus related to Embodiment 1 of the invention.
Figure 3A:
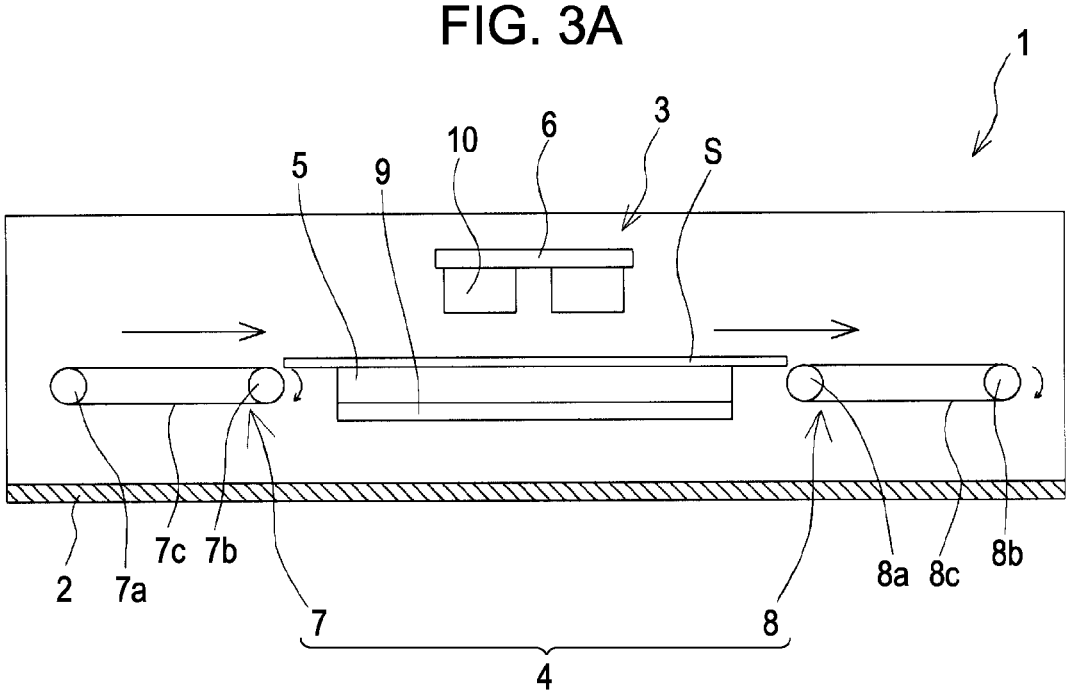
FIGS. 3A and 3B are cross-sectional views of the recording apparatus related to Embodiment 1 of the invention.
Figure 3B:
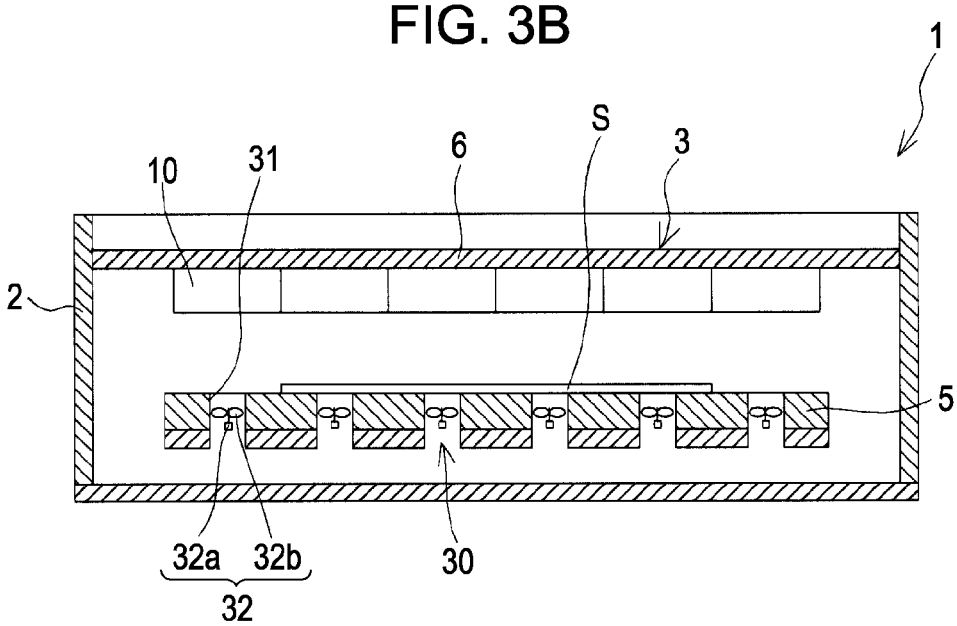

FIG. 1 is a schematic perspective view of an ink jet type recording apparatus which is one example of a liquid ejecting apparatus related to Embodiment 1 of the invention, FIG. 2 is a top view of the ink jet type recording apparatus, FIG. 3A is a cross-sectional view in the transportation direction of the ink jet type recording apparatus, and FIG. 3B is a cross-sectional view in the direction crossing the transportation direction of the ink jet type recording apparatus.

As shown in the drawings, an ink jet type recording apparatus 1 which is one example of the liquid ejecting apparatus of this embodiment is a so-called line type recording apparatus which performs printing by transporting a recording sheet S such as paper, which is an ejection-receiving medium, in a state where an ink jet type recording head is fixed. Specifically, the ink jet type recording apparatus 1 is provided with an apparatus main body 2, a head unit 3 which is provided with a plurality of ink jet type recording heads 10 and fixed to the apparatus main body 2, a transport section 4 which transports the recording sheet S, and a support section 5.

In the head unit 3, a plurality of ink jet type recording heads 10 are provided in parallel in a direction crossing a transport direction of the recording sheet S on a plate-like holding member 6. Here, in the ink jet type recording head 10, the details of which will be described later, a nozzle row including a plurality of nozzle orifices provided in parallel is provided in one row or plural rows. Also, the ink jet type recording heads 10 are disposed such that the nozzle orifices are provided in parallel in the direction crossing the transport direction of the recording sheet S. Also, a plurality of ink jet type recording heads 10 are provided in parallel in the direction crossing the transport direction of the recording sheet S, and also disposed at positions slightly shifted in the transport direction of the recording sheet S. That is, a plurality of ink jet type recording heads 10 are disposed in a zigzag form in the direction crossing in the transport direction of the recording sheet S. Also, adjacent ink jet type recording heads 10 are provided such that the nozzle orifice of an end portion of the nozzle row of one ink jet type recording head 10 and the nozzle orifice at the end portion of the nozzle row of the other ink jet type recording head 10 are in alignment with each other in the transport direction of the recording sheet S. In this way, printing can be performed in all regions over the width direction crossing the transport direction of the recording sheet S. In this embodiment, six ink jet type recording heads 10 are provided at the head unit 3.

Also, although it is not shown, an ink storage section such as ink tank or an ink cartridge, in which ink is stored, is connected to each ink jet type recording head 10 of such a head unit 3 so as to be able to supply ink. The ink storage section may also be held on, for example, the head unit 3, or may also be held at a position other than the head unit 3 in the apparatus main body 2.

The transport section 4 is provided with a first transport section 7 and a second transport section 8, which are provided on both sides of the head unit 3 in the transport direction of the recording sheet S.

The first transport section 7 is constituted by a driving roller 7*a*, a driven roller 7*b*, and a transport belt 7*c* which is wound around the driving roller 7*a* and the driven roller 7*b*. Also, the second transport section 8 is constituted, similarly to the first transport section 7, by a driving roller 8*a*, a driven roller 8*b*, and a transport belt 8*c* which is wound around the driving roller 8*a* and the driven roller 8*b*.

A driving section (not shown) such as a driving motor is connected to each of the driving rollers 7*a* and 8*a* of the first transport section 7 and the second transport section 8, and the transport belts 7*c* and 8*c* are rotationally driven by the driving force of the driving section, so that the recording sheet S is transported in upstream side and downstream side of the head unit 3.

In addition, in this embodiment, the first transport section 7 and the second transport section 8, which are constituted by the driving roller 7*a* and 8*a*, the driven roller 7*b* and 8*b*, and the transport belt 7*c* and 8*c*, are illustrated. However, holding sections which make the recording sheet S be held on the transport belts 7*c* and 8*c* may also be further provided. The holding section may also be configured such that, for example, an electrifying section which electrifies an outer face of the recording sheet S is provided, so that the recording sheet S electrified by the electrifying section is stuck to the transport belts 7*c* and 8*c* by the action of dielectric polarization. Also, the holding section may also be configured such that pushing rollers are provided on the transport belts 7*c* and 8*c*, so that the recording sheet S is grasped between the pushing rollers and the transport belts 7*c* and 8*c*.

The support section 5 is made of metal, resin, or the like so as to have a rectangular shape in cross-section and is provided between the first transport section 7 and the second transport section 8 so as to face the head unit 3. The support section 5 is for supporting the recording sheet S transported by the first transport section 7 and the second transport section 8, at a position facing the head unit 3.

Also, at the support section 5 of this embodiment, a heater 9 is provided. In this embodiment, the heater 9 is configured such that a metal material having excellent heat conductivity is used as the support section 5 and the heater 9 is provided on a face side on the opposite side to a face of the support section 5, which faces the ink jet type recording head 10. As such a heater 9, for example, an infrared lamp, an electric heater, or the like can be used.

Also, in the support section 5, a suction section 30 which attracts the recording sheet S transported onto the support section 5 is provided. The suction section 30 of this embodiment is constituted by a plurality of suction holes 31 provided in the support section 5, and suction devices 32 provided the respective suction holes 31.

The suction hole 31 is provided to be opened at a face of the support section 5, which supports the recording sheet S, and penetrate the support section 5 in a thickness direction up to a face on the opposite side to the face which supports the recording sheet S. Also, the suction device 32 which is provided in the suction hole 31 is constituted by a driving motor 32*a* (refer to FIG. 2) fixed in the suction hole 31, and a blade 32*b* provided on a rotary shaft of the driving motor 32*a*.

The suction section 30 which is constituted by a plurality of suction holes 31 and the suction devices 32 sucks and sticks the recording sheet S to the surface of the support section 5 by making the recording sheet S side above the blade 32*b* in the suction hole 31 be subjected to negative pressure by rotating the blade 32*b* by the driving of the driving motor 32*a* in the suction hole 31.

In this embodiment, a configuration is made such that in the support section 5, a row including six suction holes 31 provided along the direction (corresponding to one direction described in the appended claims) crossing the transport direction of the recording sheet S is provided in three rows in the transport direction. That is, in the support section 5 of this embodiment, a total of 18 suction holes 31, each having the suction device 32 provided in the interior, are provided.

Also, the suction section 30 which is constituted by a plurality of suction holes 31, each having the suction device 32 provided in the interior, is configured so as to be able to change suction power in one direction of the recording sheet S (in this embodiment, the width direction crossing the transport direction of the recording sheet S) by controlling the driving of each suction device 32. In addition, the change of the suction power by the control of the driving of each suction device 32 can be realized by changing the number of rotation of the driving motor 32*a*.

Figure 4:
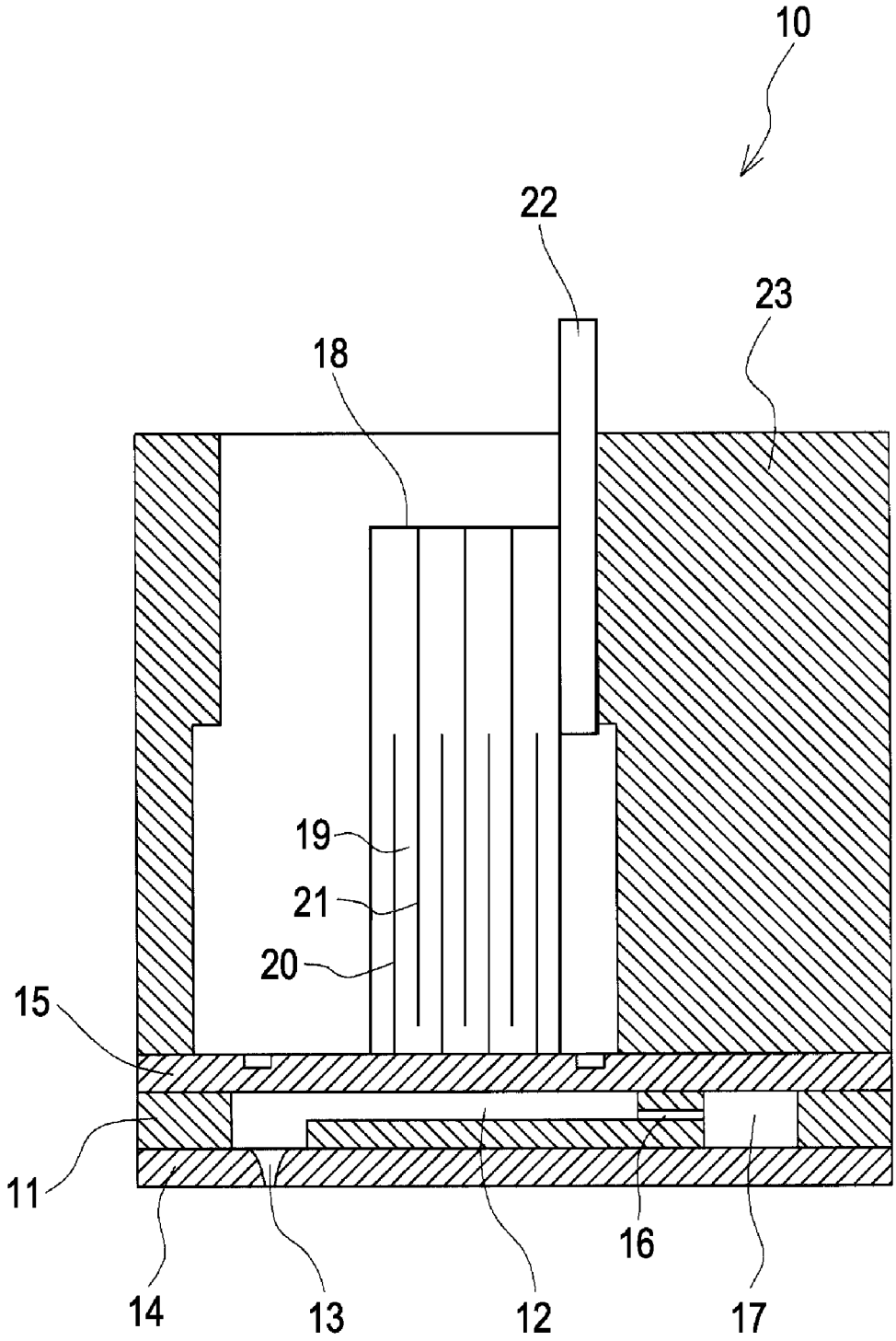
FIG. 4 is a cross-sectional view of a recording head related to Embodiment 1 of the invention.

Here, the ink jet type recording head 10 which is mounted in the ink jet type recording apparatus 1 as described above is explained. FIG. 4 is a cross-sectional view showing one example of the ink jet type recording head related to Embodiment 1 of the invention.

The ink jet type recording head 10 shown in FIG. 4 is of a type having longitudinal vibration type piezoelectric elements. In the recording head, a plurality of pressure generation chambers 12 are provided in parallel in a spacer 11, and both sides of the spacer 11 are sealed by a nozzle plate 14, which has nozzle orifices 13 provided corresponding to the respective pressure generation chambers 12, and a vibration plate 15. Further, in the spacer 11, a reservoir 17 is provided which is communicated with each pressure generation chamber through an ink supply port 16 for every pressure generation chamber 12, thereby serving as a common ink chamber to a plurality of pressure generation chambers 12, and an ink cartridge (not shown) is connected to the reservoir 17.

On the other hand, on the face of the vibration plate 15 on opposite side to the pressure generation chamber 12, the leading ends of the respective piezoelectric elements 18 are provided in contact with regions corresponding to the respective pressure generation chambers 12. In each of these piezoelectric elements 18, a piezoelectric material 19 and electrode forming materials 20 and 21 longitudinally extend and are alternately stacked in a sandwich form, and an inactive region which does not contribute to vibration is fixed to a fixing substrate 22. Also, the fixing substrate 22, and the vibration plate 15, the spacer 11, and the nozzle plate 14 are integrally fixed with a base 23 interposed therebetween.

In the ink jet type recording head 10 configured in this manner, ink is supplied to the reservoir 17 through an ink flow path which is communicated with the ink storage section, and distributed to each pressure generation chamber 12 through the ink supply port 16. In practice, the piezoelectric element 18 is contracted by applying voltage to the piezoelectric element 18. In this way, the vibration plate 15 is deformed (raised upward in the drawing) along with the piezoelectric element 18, so that a volume of the pressure generation chamber 12 is expanded, whereby ink is drawn into the pressure generation chamber 12. Then, after the interior extending up to the nozzle orifice 13 is filled with ink, if voltage applied to the electrode forming materials 20 and 21 of the piezoelectric element 18 is removed in accordance with a driving signal from a driving circuit, the piezoelectric element 18 is elongated, thereby returning to an original state. In this way, since the vibration plate 15 is also displaced, thereby returning to an original state, the pressure generation chamber 12 is contracted, so that internal pressure is increased, whereby an ink droplet is discharged out of the nozzle orifice 13. That is, in this embodiment, the longitudinal vibration type piezoelectric element 18 is provided as a pressure generator which makes pressure change occur in the pressure generation chamber 12.

Also, in a case where the ink jet type recording apparatus 1 described above performs black-and-white printing by using monochromatic ink, the ink jet type recording head 10 is disposed in the width direction of the recording sheet S at the head unit 3. Also, in a case where the ink jet type recording apparatus 1 performs, for example, color printing by ink of plural colors, it is preferable if an ink jet type recording head in which a plurality of ink jet type recording heads 10 as shown in FIG. 4 are integrally provided be used as one ink jet type recording head which is mounted as the head unit 3.

Here, a control configuration of such an ink jet type recording apparatus 1 is explained. Incidentally, FIG. 5 is a block diagram showing the control configuration of the ink jet type recording apparatus.

Figure 5:
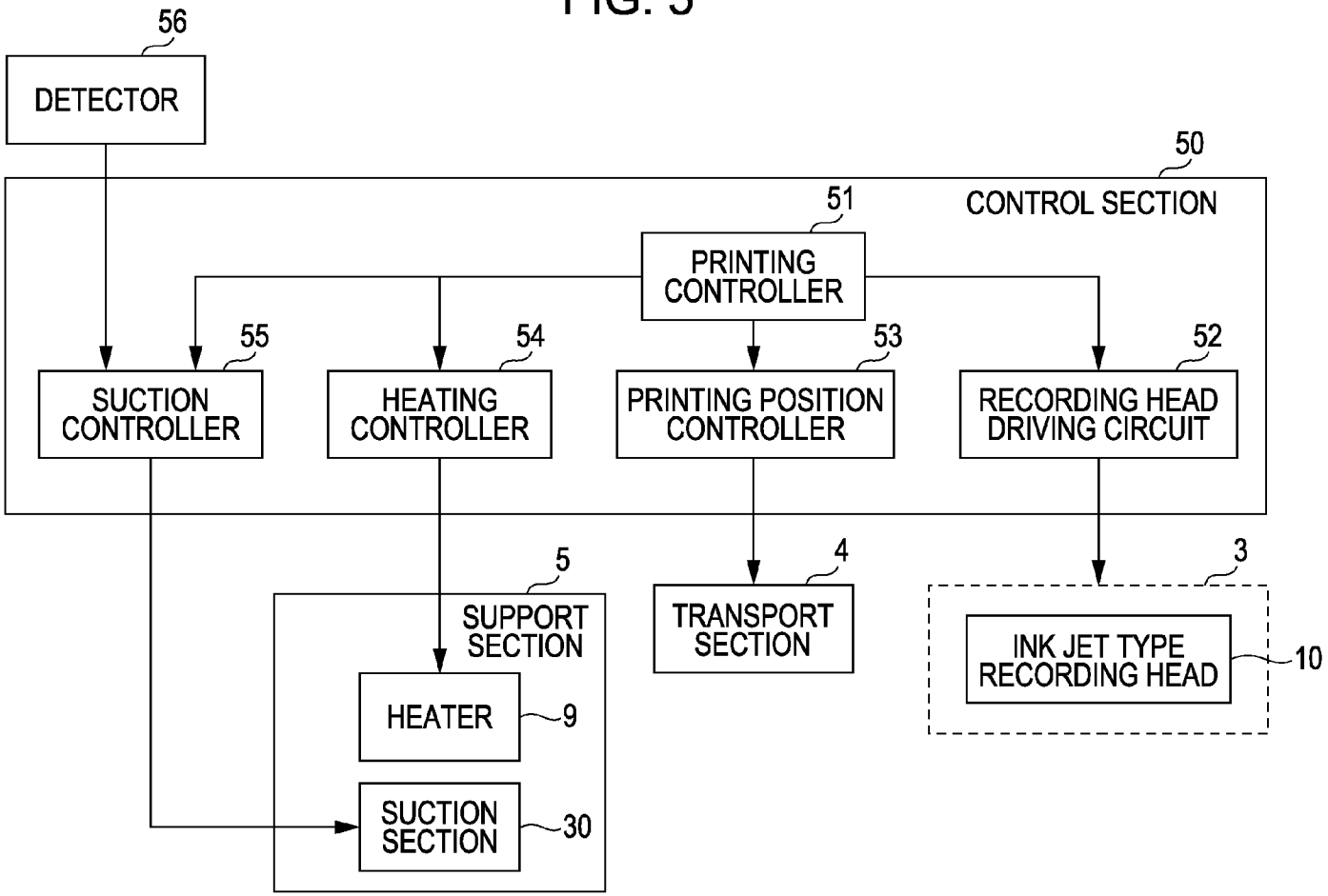
FIG. 5 is a block diagram showing a control configuration of the recording apparatus related to Embodiment 1 of the invention.

As shown in FIG. 5, the ink jet type recording apparatus 1 includes the head unit 3 which is provided with the ink jet type recording head 10 that is a mechanism section which actually performs the printing, the transport section 4 which transports the recording sheet S, the heater 9, the suction section 30, and a control section 50 which controls the operation of the ink jet type recording head 10.

The control section 50 includes a printing controller 51, a recording head driving circuit 52, a printing position controller 53, a heating controller 54, and a suction controller 55.

The printing controller 51 controls the printing operation of the ink jet type recording head 10 and, for example, applies a driving pulse to the piezoelectric element 18 through the recording head driving circuit 52 in accordance with the input of a printing signal, thereby discharging ink from the ink jet type recording head 10.

The printing position controller 53 performs the positioning of the recording sheet S at the time of the printing of the ink jet type recording head 10. That is, the printing position controller 53 controls the transportation amount of the recording sheet S which is transported to a region facing the ink jet type recording head 10 by the transport section 4, so that the positioning in the transport direction of the recording sheet S in relation to the ink jet type recording head 10 is performed.

Also, in this embodiment, a detector 56 is provided in the ink jet type recording apparatus 1. The detector 56 is to detect an ejection region (in this embodiment, a printing region) of the recording sheet S. In this embodiment, a configuration is made such that a width in the direction crossing the transport direction of the recording sheet S is detected as the ejection region. However, for example, an optical sensor which measures a width of the recording sheet S can be used as the detector 56. Also, the detector 56 is not limited to the optical sensor, but, for example, a configuration may also be adopted in which a guide which makes widths of the recording sheets S be uniform is provided in a paper cartridge in which the recording sheets S are held, and the detector 56 mechanically acquires a position of the guide. Of course, a configuration may also be made such that the detector 56 is not provided and a user which uses the ink jet type recording apparatus 1 manually inputs a width of the recording sheet S. Also, a configuration may also be adopted in which a size of the recording sheet S to be printed and a printable ejection region except a margin or the like of the recording sheet S are kept in the control section 50, and an ejection region is determined on the basis of the printing data input from the outside.

The heating controller 54 controls the heater 9, thereby heating the support section 5 so as to heat the recording sheet S supported on the support section 5, at the time of the printing by the ink jet type recording head 10. Also, the heating controller 54 performs control to stop the heating of the support section 5 by the heater 9 at the time of waiting when the printing is not performed, or in a case where the support section 5 is heated above a given temperature. In addition, a temperature of the support section 5 can be caught by a temperature sensor or the like.

The suction controller 55 controls the suction section 30 on the basis of the width direction crossing the transport direction of the recording sheet S which is detected by the detector 56.

The control of the suction section 30 by the suction controller 55 is performed so as to make the suction power of the suction devices 32 facing regions where the recording sheet S does not exist be larger than the suction power of the suction devices 32 provided at a region facing the recording sheet S, that is, a printing region where the printing is actually performed. That is, the suction power of the suction section 30 is changed in a width direction crossing the transport direction of the recording sheet S.

Figure 6A:
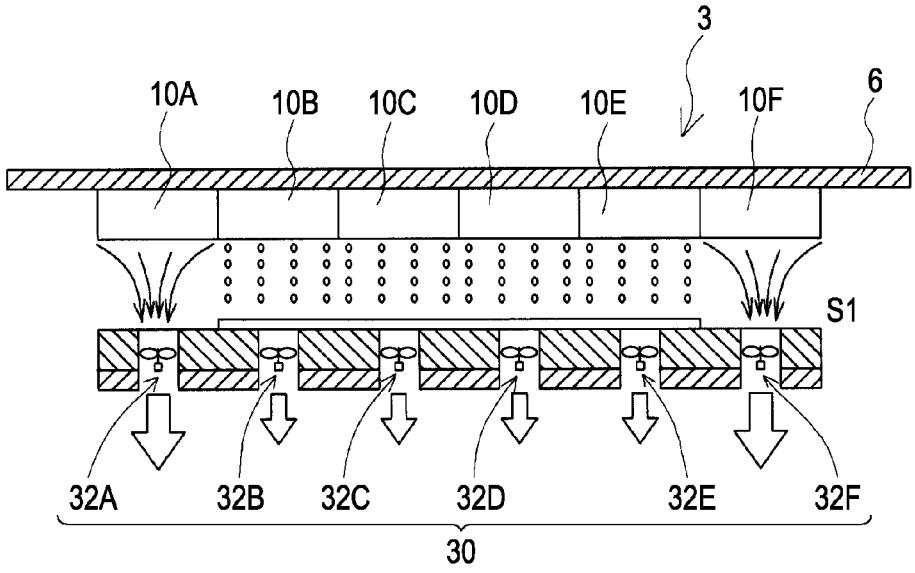
FIGS. 6A and 6B are cross-sectional views showing suction operation related to Embodiment 1 of the invention.

Specifically, as shown in FIG. 6A, the suction controller 55 makes the suction power of the suction devices 32A and 32F provided at regions where the recording sheet S1 does not exist be larger compared to the suction power of the suction devices 32B to 32E provided at a region where the recording sheet S1 to be printed exists. Here, in an example shown in FIG. 6A, since the recording sheet S1 faces four ink jet type recording heads 10B to 10E out of six ink jet type recording heads 10A to 10F, the ink jet type recording heads 10A and 10F of both ends are not used for the printing of the recording sheet S1. Therefore, the suction power of the suction devices 32A and 32F provided at regions where the recording sheet S1 does not exist is set to be larger compared to the other suction devices 32B to 32E so that temperatures at which the ink jet type recording heads 10A and 10F, which are not used for the printing of the recording sheet S1 and do not perform the discharging of ink droplets, are heated by the heater 9 are made lower.

Figure 6B:
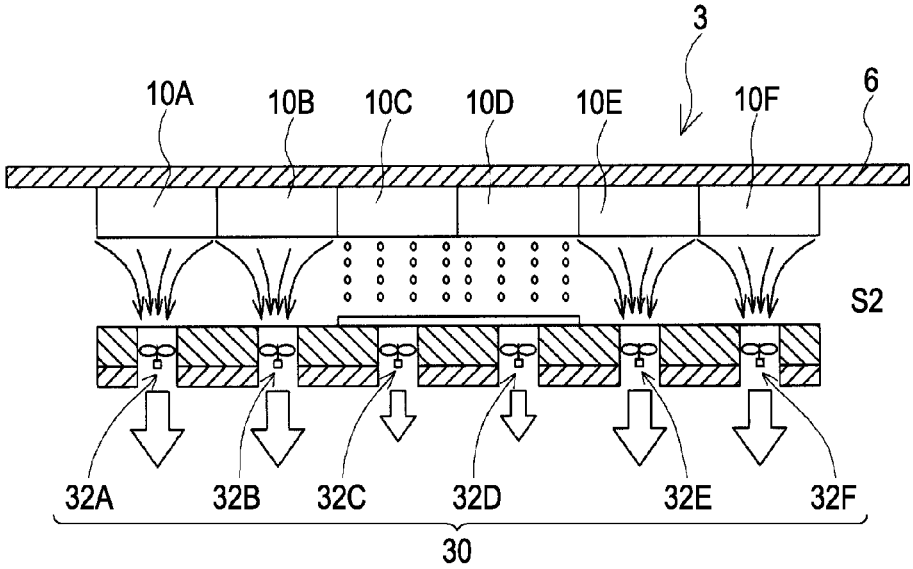

Further, also in case where the width of the recording sheet S2 is narrower than the width of the recording sheet S1, as shown in FIG. 6B, similarly, the suction controller 55 makes the suction power of the suction devices 32A, 32B, 32E, and 32F provided at regions where the recording sheet S2 does not exist be larger compared to the suction power of the suction devices 32C and 32D provided at a region where the recording sheet S2 to be printed exists. In this way, temperatures at which the ink jet type recording heads 10A, 10B, 10E, and 10F, which are not used for the printing of the recording sheet S2, are heated by the heater 9 can be made lower.

In addition, if the suction device 32 facing the ink jet type recording head 10 which is not used for the printing performs the suction of gas (air), air current is generated around the ink jet type recording head 10 which is not used for the printing, in particular, in the vicinity of the nozzle orifice 13. The ink jet type recording head 10 which is not used for the printing, in particular, the vicinity of the nozzle orifice 13 facing the suction hole 31 is refrigerated by the air current. Also, in this embodiment, since the heater 9 and the suction section 30 are provided at the support section 5, the temperature of the support section 5 adjacent to a region having high suction power can be lowered by increasing the suction power of the suction section 30 of a region where the recording sheet S does not exist. That is, although the whole of the support section 5 is heated by the heater 9, the support section is refrigerated by the air current due to the suction of the suction section 30. Also, the flow of air current at a region of the support section 5, where the suction power of the suction section 30 is high, is larger compared to that at a region where the suction power is low, so that the former region is refrigerated more than the latter region. In this way, the temperature of the region of the support section 5, where the suction power is low, is high, whereas the temperature of the region of the support section, where the suction power is high, can be lowered. In this way, by making the temperature of the region which is a portion of the support section 5 heated by the heater 9 and in which the recording sheet S does not exist be lower compared to the temperature of the region on which the recording sheet S is provided, the temperature at which the ink jet type recording head 10, which is not used for the printing, is heated by the heat of the support section 5 can be lowered.

In this manner, by lowering the heated temperature particularly of the vicinity of the nozzle orifice 13 of the ink jet type recording head 10, which is not used for the printing, it can be suppressed that viscosity of ink of the vicinity of the nozzle orifice 13 is increased by heating, so that a trouble such as the clogging of the nozzle orifice 13 or the discrepancy of a landing position at the time of the start of the discharging of the ink droplets occurs.

Also, by allowing the suction section 30 to lower the temperature at which the ink jet type recording head 10 facing the region where the recording sheet S does not exist is heated by the heater 9, reduction in the durability of the ink jet type recording head 10 due to the heating can be suppressed. That is, if the ink jet type recording head 10 is heated, an adhesive agent or the like, which bonds the constituent members of the ink jet type recording head 10 to each other, is adversely affected, so that there is a fear that durability of the ink jet type recording head 10 is reduced. However, the heating of the ink jet type recording head 10 which is not used for the printing is suppressed, so that reduction in the durability of the ink jet type recording head 10 can be suppressed. In addition, in the region where the recording sheet S exists, since the heat of the heater 9 is blocked by the recording sheet S, if the suction power of the suction section 30 is not adjusted, the heated temperature of the region is low compared to the ink jet type recording head 10 of the region where the recording sheet S does not exist. Also, in the region where the recording sheet S exists, in addition to the blocking of heat by the recording sheet S, since the discharging of the ink droplets from the nozzle orifice 13 is performed, even if ink of the vicinity of the nozzle orifice 13 is heated, the heated ink is discharged, so that clogging due to increase in viscosity or discrepancy of a landing position hardly occurs.

In addition, since the suction controller 55 only increases the suction power of the suction devices 32 of the region which is not used for the printing, the suction and adhesion of the recording sheet S to the support section 5 is reliably performed by the suction devices 32 provided at the printing region. Therefore, the recording sheet S is reliably fixed, so that high-precision printing can be performed.

Also, since the suction controller 55 only increases the suction power of a non-printing region other than the printing region (recording sheet S) of the suction section 30, in the printing region (the region on which the recording sheet S is provided), damage to the heated temperature of the recording sheet S by the heater 9 can be reduced. Therefore, the heating of the recording sheet S by the heater 9, that is, the heating of ink coated on the recording sheet S can be excellently performed.

In addition, although it can also be considered to divide a heater, which heats the recording sheet S, in one direction (in this embodiment, the width direction crossing the transport direction of the recording sheet S) and individually control the divided heaters, thereby partly changing the heated temperature of the recording sheet S, even if the heater is divided, thermal reactivity of the support section 5 is low, so that it is difficult to partly adjust a support member to a desired temperature. On the contrary, in the invention, extra heating of only the ink jet recording head 10 which is not used for the printing can be suppressed by the suction section 30.

Further, in the above-described example, recording sheets having widths which correspond with the boundary portions of the ink jet recording heads 10A to 10F provided in parallel are illustrated as the recording sheets S1 and S2, and the suction section 30 is provided in the same number as the number of ink jet type recording heads 10 in the direction crossing the transport direction of the recording sheet S1 or S2, so that the suction power of the suction devices 32A to 32F where the recording sheet S1 or S2 does not exist is controlled. However, the invention is not to be limited to such conditions.

For example, in a case where the edge portion in the width direction of the recording sheet S exists above the suction device 32B, only the suction power of the suction device 32A may also be increased. In this case, in the nozzle orifices 13 of one ink jet type recording head 10B, the nozzle orifice 13 which is used for the printing and the nozzle orifice 13 which is not used for the printing exist. However, since the nozzle orifice 13 of the ink jet type recording head 10B, which is not used for the printing, is located on the suction device 32A side, in which the suction power is high, the heated temperature of the vicinity of the nozzle orifice 13 of the ink jet type recording head 10B, which is not used for the printing, is also lowered. Of course, the number of the suction devices 32 and the number of the ink jet type recording heads 10 in the same direction (the direction crossing the transport direction of the recording sheet S) may not be the same number.

Also, in this embodiment, a configuration is made such that the suction power of the suction devices 32A to 32F of the suction section 30, which are provided in parallel in the width direction (one direction) crossing the transport direction of the recording sheet S is adjusted. However, for example, a configuration may also be made such that the suction power of the suction devices 32 which are provided in parallel is adjusted in the transport direction of the recording sheet S. That is, at the time of the start of the printing and the time of the end of the printing of the recording sheet S, the end portion in the transport direction of the recording sheet S exists on the support section 5, so that also in the transport direction, a region where the recording sheet S exists and a region where the recording sheet S does not exist. Therefore, in the transport direction, the suction power of the region of the suction section 30, where the recording sheet S does not exist, may also be increased compared to the suction power of the region of the suction section, where the recording sheet S exists.

Other Embodiments

Figure 7:
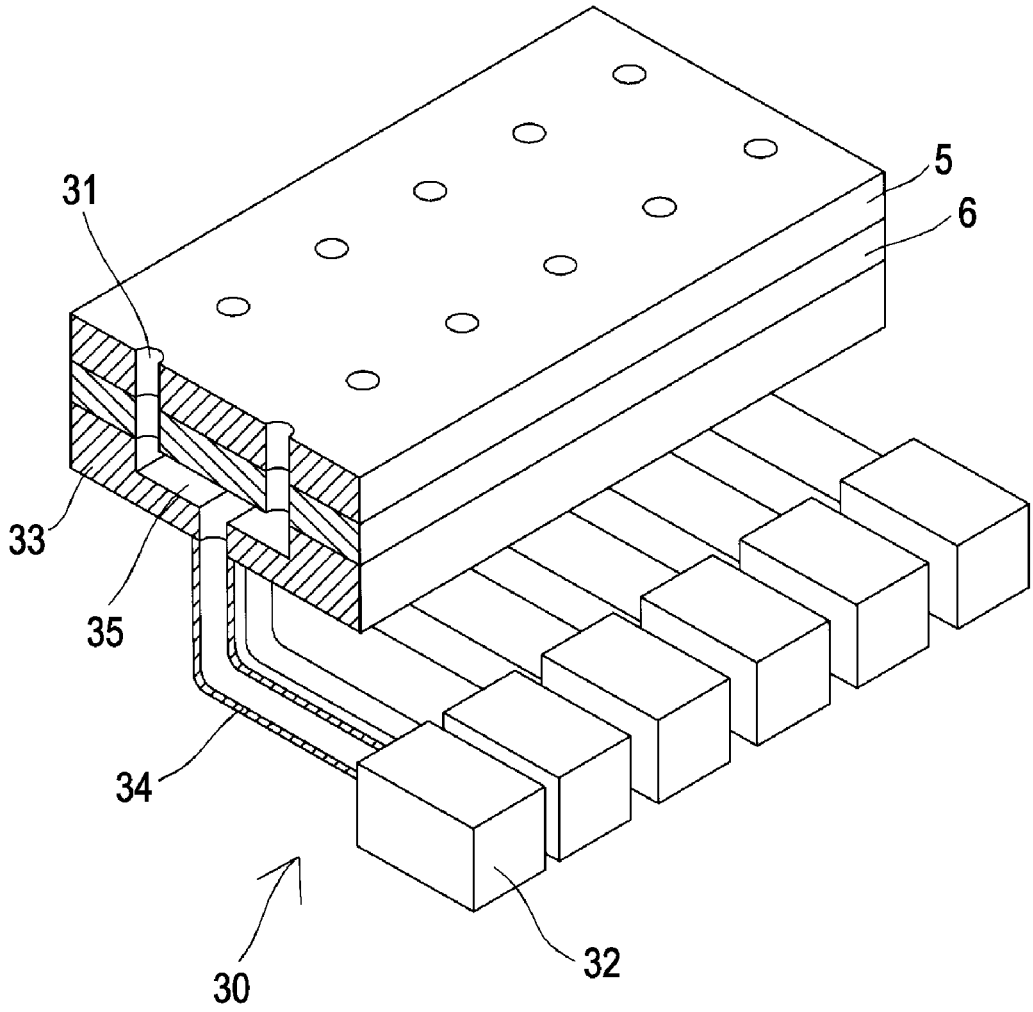
FIG. 7 is a perspective view showing another example of a suction section related to another embodiment of the invention.

Although one embodiment of the invention has been described above, the basic configuration of the invention is not to be limited to the foregoing. For example, although in Embodiment 1 described above, the suction section 30 is constituted by a plurality of suction holes 31 provided in the support section 5, and the suction devices 32 provided in the respective suction holes 31, the suction section 30 is not to be particularly limited to this configuration. Here, another example of the suction section is shown in FIG. 7. Incidentally, FIG. 7 is a perspective view showing another example of the suction section related to another embodiment of the invention. Further, the same members as those of Embodiment 1 described above are denoted by the same numbers and overlapping explanation is omitted.

As shown in FIG. 7, a plurality of suction holes 31 are provided in the support section 5. Also, the suction device 32 is connected to the suction hole 31 which is opened at a face on the opposite side to the face of the support section 5, which supports the recording sheet S, through a collecting tube 33 and a suction tube 34.

The collecting tube 33 is common to and communicated with a row of the suction holes 31 arranged in the transport direction of the recording sheet S and is connected to the suction device 32 through one suction tube 34. Specifically, the collecting tube 33 is provided with a communication hole 35 having an opening of a size covering three suction holes 31 arranged in a row on the support section 5 side. Also, the communication hole 35 of the collecting tube 33 has a reduced opening on the opposite side to the support section 5 and is connected at the opening to the suction tube 34.

The collecting tube 33, the suction tube 34, and the suction device 32 are provided in a plurality of numbers corresponding to the number of the suction holes 31 provided in parallel in the width direction (one direction) crossing the transport direction of the recording sheet S. In the example shown in FIG. 7, since six suction holes 31 are provided in the width direction of the recording sheet S, the collecting tubes 33, the suction tubes 34, and the suction devices 32 are respectively provided in six pieces.

In this manner, the suction hole 31, the collecting tube 33, the suction tube 34, and the suction device 32 are provided in a plurality of numbers and in parallel in the width direction (one direction) crossing the transport direction of the recording sheet S, thereby constituting the suction section 30. In this way, only by changing the suction power of the suction devices 32 in the width direction of the recording sheet S, it can be suppressed that the ink jet type recording head 10 which is not used for the printing is heated to a high temperature.

Also, in Embodiment 1 described above or the example shown in FIG. 7, a plurality of suction devices 32 are provided. However, the present is not particularly limited to this, but, for example, one suction device which is communicated with all suction holes 31, thereby performing suction may also be provided. In this case, if a valve mechanism which can change an opening area is provided in each suction hole 31, it is possible to make the suction power of the region where the recording sheet S does not exist be larger compared to the suction power of the region where the recording sheet S exists. That is, the suction section according to the invention is not to be limited to those described above, provided that suction power can be changed in one direction of the recording sheet S.

Also, in Embodiment 1 described above, a configuration is made such that the head unit 3 which is provided with the ink jet type recording head 10 is fixed to the apparatus main body 2 and the transport section 4 transports the recording sheet S. However, since it is enough if the transport section 4 relatively moves the ink jet type recording head 10 and the recording sheet S, a configuration may also be made such that the recording sheet S is fixed and the transport section 4 transports the ink jet type recording head 10. A transport direction in such a case is the same as that in Embodiment 1 described above. Also, in a state where the ink jet type recording head 10 is provided in a plurality of numbers also in the direction crossing the transport direction of the recording sheet S of Embodiment 1 described above and the recording sheet S is not moved, but the recording sheet S is fixed, printing may also be performed on all ejection regions of the recording sheet S by the fixed the ink jet type recording head 10. That is, the transport section 4 of Embodiment 1 described above may not be substantially provided. Of course, the invention can also be applied to an ink jet type recording apparatus which performed the printing on the entire face of the recording sheet S by moving the recording sheet S in the transport direction while moving the head unit 3 in the direction (one direction) crossing the transport direction of the recording sheet S.

Also, in Embodiment 1 described above, as the pressure generator which makes pressure change occur in the pressure generation chamber 12, the longitudinal vibration type piezoelectric element 18, in which the piezoelectric material 19 and the electrode forming materials 20 and 21 are alternately stacked so that the piezoelectric element is elongated and contracted in a longitudinal direction, is illustrated. However, the invention is not particularly limited to this, but, for example, as a flexural vibration type piezoelectric element constituted by interposing a piezoelectric material layer made of a crystallized piezoelectric material between two electrodes, a lower electrode layer and an upper electrode layer, a thin film type piezoelectric element in which the respective layers are stacked by a film formation or lithography method, or a thick film type piezoelectric element which is formed by a method of attaching a green sheet, or the like can be used. Also, as the pressure generator, an element which discharges liquid droplets out of a nozzle orifice by bubbles which are generated heat generation of a heater element disposed in a pressure generation chamber, a so-called electrostatic actuator which discharges liquid droplets out of a nozzle orifice by generating static electricity between a vibration plate and an electrode and deforming the vibration plate by electrostatic force, or the like can be used.

In addition, the invention broadly targets liquid ejecting apparatuses in general, which are provided with the liquid ejecting head, and can also be applied to, for example, an image recording apparatus such as a printer, a color material ejecting apparatus used for the manufacturing of a color filter of a liquid crystal display or the like, an electrode material ejecting apparatus used for the formation of the electrode of an organic EL (electroluminescence) display, a FED (Field Emission Display), or the like, a biological organic matter ejecting apparatus used for the manufacturing of a biochip, or the like.

What is claimed is:

1. A liquid ejecting apparatus comprising:

a liquid ejecting head provided with nozzle orifices which eject liquid;

a heater provided facing a liquid ejecting face of the liquid ejecting head;

a transport section which transports an ejection-receiving medium between the liquid ejecting head and the heater; and a suction section which sucks the ejection-receiving medium toward the opposite side of the liquid ejecting head;

wherein the suction section is provided so as to be able to change suction power in a plurality of regions along one direction of the ejection-receiving medium, and the liquid ejecting apparatus further includes a suction controller which controls the suction power in a plurality of regions of the suction section along one direction on the basis of the width in one direction of the ejection-receiving medium, wherein the suction controller performs control so as to make the suction power of a region of the suction section, where the ejection-receiving medium does not exist, be larger compared to the suction power of a region of the suction section, which faces the ejection-receiving medium.

2. The liquid ejecting apparatus according to claim 1, wherein a support section which supports the ejection-receiving medium is provided at a region which faces the liquid ejecting face of the liquid ejecting head, the heater is provided at the support section, and the suction section includes a plurality of suction holes provided along one direction in a region of the support section, which faces the liquid ejecting face, so that the suction section sucks and sticks the ejection-receiving medium to the support section.

3. The liquid ejecting apparatus according to claim 1, wherein a plurality of nozzle orifices are provided along one direction of the ejection-receiving medium.

4. The liquid ejecting apparatus according to claim 1, wherein the liquid ejecting head is provided in a plurality of numbers along one direction of the ejection-receiving medium.

5. The liquid ejecting apparatus according to claim 1, wherein one direction of the ejection-receiving medium is a direction crossing the relative movement direction of the liquid ejecting head and the ejection-receiving medium.

* * * * *